United States Patent [19]

Kaeser

[11] Patent Number: 4,467,964

[45] Date of Patent: Aug. 28, 1984

[54] AUTOMATIC MIXING DEVICE FOR USE IN A SHOWER HEAD

[76] Inventor: Charles Kaeser, 18, chemin de Rennier, Pully, Switzerland

[21] Appl. No.: 312,704

[22] Filed: Oct. 19, 1981

[30] Foreign Application Priority Data

Nov. 19, 1980 [CH] Switzerland ..... 8552/80

[51] Int. Cl.[3] ..... B05B 9/03

[52] U.S. Cl. ..... 239/312; 137/101.11; 137/564.5; 239/313; 239/315; 239/447; 239/449

[58] Field of Search ..... 239/310, 312, 313, 315, 239/316, 317, 447–449; 137/101.11, 205.5, 268, 564.5

[56] References Cited

U.S. PATENT DOCUMENTS

| | | | |
|---|---|---|---|
| 1,476,090 | 12/1923 | Lipsner et al. | 239/312 |
| 1,579,869 | 4/1926 | Klages | 239/312 |
| 3,018,969 | 1/1962 | Gentry | 239/312 |
| 3,342,419 | 9/1967 | Weese | 239/313 |
| 4,203,550 | 5/1980 | On | 239/447 |

FOREIGN PATENT DOCUMENTS

| | | | |
|---|---|---|---|
| 648019 | 9/1962 | Canada | 137/564.5 |

*Primary Examiner*—John J. Love
*Assistant Examiner*—Michael J. Forman
*Attorney, Agent, or Firm*—Lerner, David, Littenberg, Krumholz & Mentlik

[57] ABSTRACT

A mixing device is disclosed for the purpose of mixing a first fluid with a second fluid contained in a pressurized stream. The device includes a first fluid chamber for holding the first fluid, which includes a closure surface, an inlet, and an outlet, a second fluid inlet, a second fluid outlet, a second fluid circuit for directing the second fluid stream from the second fluid inlet to the second fluid outlet, a membrane slidably contained within the first fluid chamber and having one surface facing the closure surface, and an orifice between the membrane surfaces so that the first fluid can flow through that orifice, a spring in contact with the inner surface of the membrane to normally urge its surface against the closure surface in order to prevent the flow of the first fluid through the orifice, a second fluid valve for selectively directing at least a portion of the second fluid stream through the inlet of the first fluid chamber against the outer surface of the membrane so as to urge it against the spring and thereby separate the surface of the membrane from the closure surface and permit the first fluid to flow through the orifice and mix with the second fluid to create a fluid mixture, and a fluid mixture conduit for directing the fluid mixture thus prepared from the outlet of the first fluid chamber to the second fluid outlet. This mixing device can thus be incorporated into a shower head or the like so as to permit the shower head to be operated either with the second fluid alone, or with a mixture of first and second fluids, and at the same time preventing any flow of first fluid when there is no flow of the second fluid.

20 Claims, 7 Drawing Figures

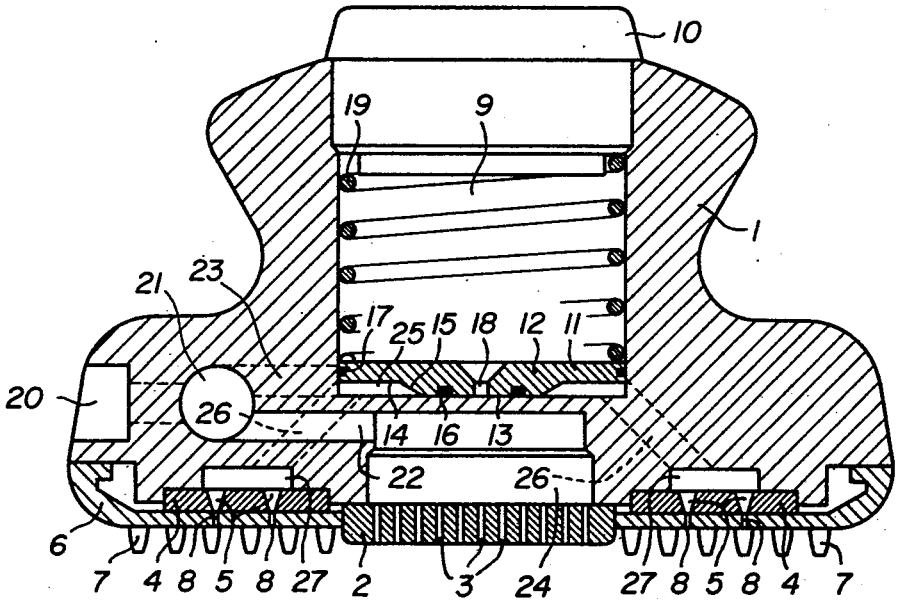
FIG. 1
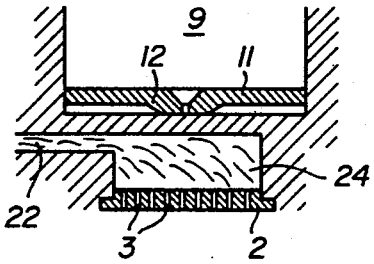
FIG. 2A
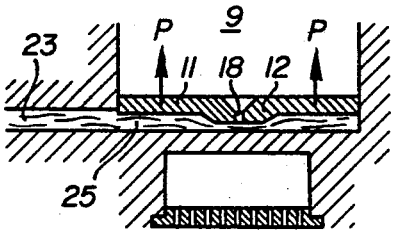
FIG. 2B
FIG. 2C
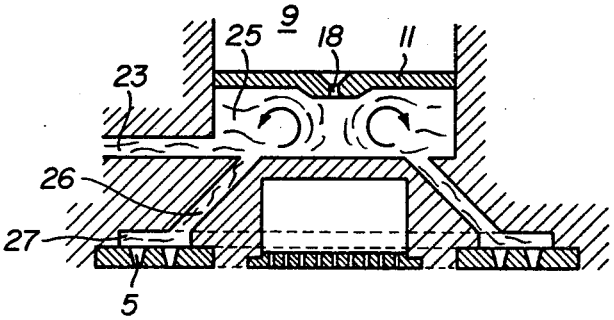

FIG. 3A
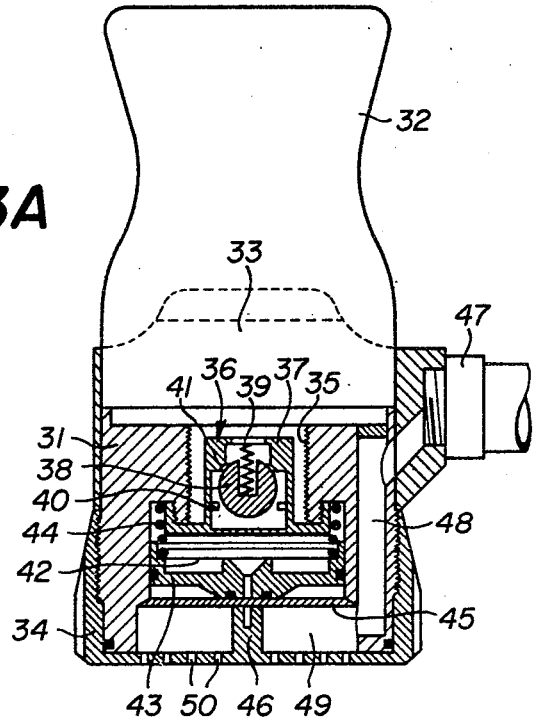
FIG. 3B
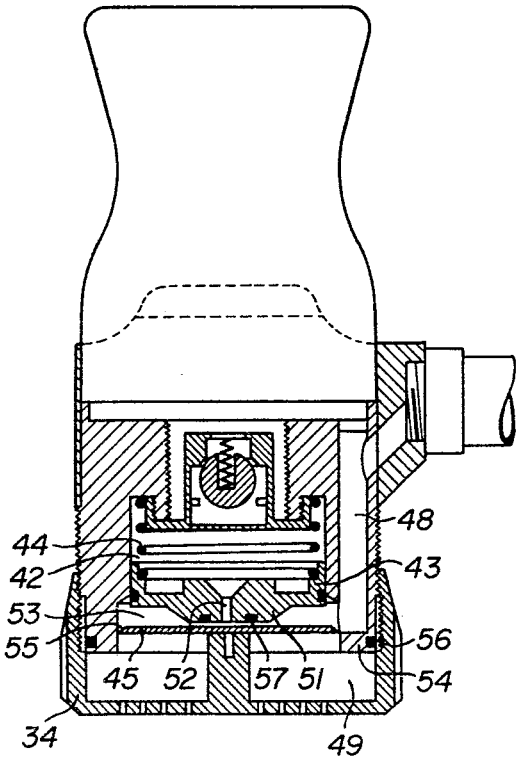
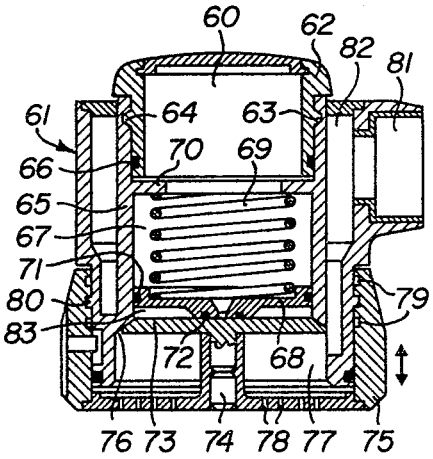
FIG. 4

AUTOMATIC MIXING DEVICE FOR USE IN A SHOWER HEAD

FIELD OF THE INVENTION

The present invention relates to mixing devices for mixing two fluids with each other. More particularly, the present invention pertains to automatic mixing devices for adding liquid cosmetic products to a stream of water, such as a water contained in a supply pipe under pressure. Still more particularly, the present invention relates to such automatic mixing devices in which a predetermined quantity of a liquid cosmetic product is contained in a chamber, and is mixed with a stream of water for supply to at least one outlet pipe for the water mixed with the liquid cosmetic products.

BACKGROUND OF THE INVENTION

One type of known mixing system is of the GIFAR type. Such systems consist of a main tube or conduit in which the water circulates, and to which a pipe is joined, the pipe being connected to a tank of liquid cosmetic products, such a liquid soap. A deflector is then situated in the main conduit so as to produce a depression at the level of the joint of the attached pipe, thereby permitting a certain quantity of liquid soap to be drawn in, so as to mix with the water in the main conduit.

This well-known device presents a number of inconveniences, however. In particular, it does not have any closing device to assure that the level of the soap in the tank is water tight, so that the liquid soap may be permitted to enter the pipe of running water even after the faucet has been closed. Furthermore, the flow of the soap is dependent upon several parameters, including the flow of the water in the main tube, the pressure of the water in the pipe, etc. Thus, the flow of soap is rendered practically uncontrollable, and of necessity each device must therefore be adapted to the individual conditions at the time of its installation. Finally, it has been noted that these types of devices large quantities of water are used for a very small quantity of liquid soap.

SUMMARY OF THE INVENTION

In accordance with the present invention, these inconveniences may be remedied by producing a mixing device in which the tank of liquid soap is isolated with regard to the pipe containing the water under pressure, and in such a way that the soap cannot exit from that tank except when the water is circulating through the device.

In accordance with this invention a mixing device is thus provided for mixing a first fluid with a second fluid in which the second fluid is contained in a pressurized stream, the mixing device comprising a first fluid chamber for holding a predetermined quantity of the first fluid, the first fluid chamber including a closure surface, an inlet, and an outlet, second fluid inlet means, second fluid outlet means, second fluid circuit means for directing said second fluid stream from said second fluid inlet means to said second fluid outlet means, membrane means slidably contained within the first fluid chamber, the membrane means including a first surface in contact with said first fluid within said first fluid chamber, a second surface facing said closure surface, an orifice connecting the first and second surfaces so that the first fluid can flow out of the first fluid chamber through the orifice, bias means for contact with the first surface of the membrane means so as to normally urge the second surface of the membrane means against the closure surface so as to prevent the flow of the first fluid through the orifice, second fluid control means for selectively directing at least a portion of the second fluid stream through the inlet of the first fluid chamber and against the second surface of the membrane means so as to urge the membrane means against the bias means so as to separate the second surface of the membrane means from the closure surface and thereby permit the first fluid to flow through the orifice and mix with the second fluid to thereby create a fluid mixture, and fluid mixture flow means for directing the fluid mixture from the outlet from the first fluid chamber to the second fluid outlet means. Preferably the first fluid comprises a liquid cosmetic product and the second fluid comprises a stream of pressurized water.

In accordance with one embodiment of the apparatus of the present invention, the membrane means includes a central raised boss portion on its second surface normally in contact with the closure surface, and an annular surface surrounding the centrally raised boss portion, the annular surface normally separated from the closure surface, with the orifice being associated with the centrally raised boss portion thereof. Preferably, the centrally raised boss portion and the annular surface are located in substantially parallel planes, and are connected by a slanted portion therebetween.

In one embodiment of the apparatus of the present invention the mixing devices are contained within a shower head body.

In a preferred embodiment, the bias means comprises a coil spring, and preferably the second fluid control means comprises a dual position sluice gate.

In accordance with one embodiment of the apparatus of the present invention, the second fluid outlet means includes a first portion and a second portion, the first portion being in contact with the second fluid circuit means for receiving the second fluid from the second fluid inlet means, and the second portion being in contact with the fluid mixture flow means for receiving the fluid mixture from the first fluid chamber. Preferably, the first portion is a central circular portion and the second portion is an annular surface surrounding the central circular portion.

BRIEF DESCRIPTION OF THE DRAWINGS

The present invention can be better understood by referring to the detailed description of a sample design of the device in conjunction with the attached drawings, in which:

FIG. 1 is a side, sectional, elevational view of one form of the automatic mixing device of the present invention, mounted on a shower head;

FIG. 2A is a side, schematic representation of one aspect of the operation of the mixing device shown in FIG. 1;

FIG. 2B is a side, schematic representation of another aspect of the operation of the mixing device shown in FIG. 1;

FIG. 2C is a side, schematic representation of yet another aspect of the operation of the mixing device shown in FIG. 1;

FIG. 3A is a side, sectional, elevational view of another form of a shower head equipped with an automatic mixing device according to the present invention, the device being represented in its rest position;

FIG. 3B is a side, sectional, elevational view of the automatic mixing device shown in FIG. 3A, in this case represented in its working position; and FIG. 4 is a side, sectional, elevational view of yet another form of a mixing device according to the present invention.

DETAILED DESCRIPTION

Referring to the figures, in which like numerals refer to like portions thereof, FIG. 1 shows the automatic mixing device hereof mounted in a shower head consisting of body 1, which is fitted, at the center of its base with a plate 2 crossed by a multitude of holes 3. Around the plate 2 of this base, the body of shower head 1 includes a ring-shaped plate 4, also crossed by a series of holes 5, in this case having a conical form, and arranged, for example, in two concentric rows. This show head may optionally be equipped with a brush 6 fitted with a series of teeth 7, which may for example be made of rubber, and which is crossed by openings 8 arranged to be located in the extension of holes 5 of the ring-shaped plate 4.

The body 1 of the shower head consists of a hollow center which constitutes a chamber 9 designed to hold the cosmetic products, such as liquid soap, for example. Chamber 9 is hermetically closed by a plug 10 which can be screwed onto body 1. The plug 10 can be replaced by a tank, which can be screwed onto the body of the shower head, and which can contain a reserve of cosmetic products.

In the interior of chamber 9 is a circular membrane 11, the diameter of which is preferably very slightly less than the diameter of the cylindrical chamber 9, such that the membrane 11 can be displaced within the interior of the chamber by overcoming a slight amount of friction. The upper surface of membrane 11 is flat. The lower surface of membrane 11 has a central boss 12, the flat central area 13 of which is encircled by a ring-shaped area 14, which is parallel to and at a different level than the central area 13, with these two levels being joined by a slanted surface 15. In other words, the central boss 12 has a truncated cone shape, and the thickness of membrane 11 is greater, at the level of central area 13, than that measured at the level of the peripheral area 14. The membrane 11 is maintained in a watertight condition with respect to the lower surface of chamber 9 and its lateral walls, by means of joints 16 and 17, respectively. At the center of membrane 11 is an orifice 18, the opening of which, in contact with the interior of chamber 9, is in the form of a funnel, the lower extremity of which is plugged by the lower surface of chamber 9, when the membrane is in the position represented by FIG. 1. A spring 19, for example a coil spring, having an exterior diameter which is equal to the interior diameter of chamber 9, pushes on the upper surface of membrane 11 and returns it to its rest position (as represented by FIG. 1).

The body 1 of the shower head includes a supply pipe 20 of water under pressure, which is in contact with a dual position sluice gate 21 (represented schematically by a circle). This sluice gate 21 has two outlets, one such outlet 22 being represented by full lines and the other outlet 23 being represented by broken lines. The outlet 22 supplies water to a chamber 24 located in the body 1 of the shower head above the plate 2 of the central base, and which thus permits use of the shower head supplied directly from supply pipe 20 with water under the pressure thereof, i.e., when sluice gate 21 is in the appropriate position.

When sluice gate 21 is in its second position, outlet 22 is plugged, and the pressurized water from supply 20 is directed onto outlet 23, from which it penetrates into ring-shaped chamber 25 as defined on one side by the lower surface of membrane 11 and on the other by the surface of the bottom of chamber 9. Conduits 26 (represented by dotted lines) connect the ring-shaped chamber 25 with a chamber 27, also ring-shaped, located within the body 1 of the shower head, which is in turn connected to outlet holes 5 and 8, permitting ejection of the water mixed with the cosmetic products therethrough.

Operation of this mixing device will be explained in a more detailed manner below, with reference to FIGS. 2A to 2C.

FIG. 2A represents the shower head during its normal usage, i.e., with the water under pressure being supplied by pipe 22 to chamber 24, and then through the orifices 3 in the base plate 2. Membrane 11 is thus in its rest position, i.e., with the central boss 12 resting against the lower surface of chamber 9.

FIG. 2B represents initiation of use of the mixing device hereof. When sluice gate 21 (not represented in this figure) is altered to its second position, the water under pressure now penetrates pipe 23 and chamber 25, in such a way that the membrane 11 is now raised in the direction of arrows P. The force exerted by the pressure of the water in chamber 25 is opposed by the action of spring 19 such that the central boss 12 moves away from the lower surface of the chamber 9, thus freeing orifice 18 and permitting the flow of a determined quantity of liquid cosmetic products therethrough.

FIG. 2C illustrates a later phase in the use of this same device. The water under pressure, supplied by pipe 23, now undergoes turbulence inside chamber 25, which causes small alternative displacements of membrane 11, such that the liquid soap contained in the chamber 9 is sucked or pumped through the orifice 18 in said chamber 25. The mixture of water and cosmetic products now contained in chamber 25 flows through pipes 26 into chamber 27, and is finally pushed through holes 5.

Due to the fact that the pressure of a supply of running water is rarely constant, fluctuations of pressure are produced in chamber 25, and a forced ejection of the mixture at the outlet of holes 5 is observed. Depending on the diameter of the orifice 18, one can control, in a relatively precise fashion, the quantity of cosmetic products which are mixed with a given volume of water under pressure. On the other hand, when the sluice gate is placed in a middle position between the two extreme positions discussed above, it is possible to eject pure water through the central area of the shower head and, at the same time, water mixed with cosmetic products through its peripheral area.

FIG. 3A represents another form of the mixing device hereof seated in the interior of a shower head. As before, this shower head consists of a body 31 which can either have a tank 32 mounted thereover, or can be closed by a cover 33 (represented by dotted lines). The base of body 31 is covered by a cap 34 which is mounted on body 31 in such a manner that it can be rotated around the axis of this body and at the same time sustain an axial displacement with respect thereto. This rotation of cap 34 is limited, however, such that the cap can occupy two outer axial positions, represented respectively by FIGS. 3A and 3B.

When the shower head is equipped with a tank 32, it can include within the interior of body 31, a cut-out 35, constructed to contain a take-up valve 36. The function of this valve 36 is to assure that the tank 32 is not under pressure when the device is functioning. This fly-back valve 36 consists of a bell-shaped body 37, within the interior of which is located a ball 38 which is loaded by spring 39, tending to push ball 38 toward the bottom against a ring-shaped abutment 40. Body 37 is seated rigidly in cut-out 35, and the interior of body 37 (which is in the form of a bell) is in contact with the interior of tank 32. When the ball 38 has a pressure exerted on its lower part, it is driven upward, pushing against the seat 41, which is composed of a retaining wall situated on the interior wall of the the body 37, and which thus blocks contact with the interior of tank 32. This valve is optional, and is provided merely as a safety measure so that tank 32, preferably constructed of a synthetic material, is not subjected to a pressure which is too great.

In the interior of the body 31 of the shower head, and below the cut-out 35, is a chamber 42, in which is seated a membrane 43 and a coil spring 44 tending to push the membrane 43 against an interdependent retaining plate 45, through a central column 46 of cap 34. An opening 47 is connected with an internal water supply pipe 48, which leads to chamber 49, and is then ejected through orifices 50 located in the plate of the base of cap 34 when this cap is in the position illustrated in FIG. 3A. In this position, the shower is used without the mixer. That is, the water in supply pipe 48 is directly ejected through orifices 50, without being mixed with a cosmetic product.

FIG. 3B represents the cap 34 in its lower position, i.e., in a position which permits the mixing of water and cosmetic products.

As before, the membrane 43 consists of a central boss 51 having an orifice 52. The spring 44 tends to push the membrane 43 against the plate of base 45 in a manner which blocks the orifice and restricts the flow of liquid soap from the chamber 43 toward chamber 53, which is defined by the lower surface of membrane 43 and the upper surface of plate 45.

When one screws cap 34 toward its lower position, the plate 45 will be seated against the lower wall 54 of the suply pipe 48, in such a manner that the water supplied by this pipe goes into chamber 53, causes membrane 43 to vibrate, and forces the flow of liquid soap through orifice 52. The mixture thus obtained pours into chamber 49, which is located under plate 45, by means of an opening 55 located between plate 45 and the adjacent wall of body 31 of the shower head. A toric joint 56 assures the watertightness between the cap 34 and the body 31 of the shower head. A second toric joint 57 is situated in a circular groove at the base of membrane 43 and assures watertightness between this membrane and plate 45.

FIG. 4 represents a somewhat simplified variation of the device in FIGS. 3A and 3B. In this device, the shower head consists of a body 61 closed by a stopper 62 which is screwed or encased by the attachment of a peripheral strip 63 in a supplementary circular groove 64 located in a wall 65 of body 61. Watertightness between plug 62 and wall 65 is assured by a toric joint 66.

As in the example shown in FIGS. 3A and 3B, the body 31 bounds a chamber 67 serving as a tank for the liquid soap. Chamber 67 is connected to the hollowed interior 60 of the plug 62, which enlarges its capacity. Inside chamber 67 are arranged a membrane 68, identical to the membrane 43 of FIG. 3, and a coil spring 69 which rests on a retaining wall 70 situated at the upper end of chamber 67, and on the upper face of membrane 68. As before, joints 71 and 72 assure the watertightness between the membrane and, respectively, the lateral walls and the bottom of chamber 67.

The bottom of chamber 67 is made up of a plate 73, held by means of a central support 74, of a cap 75, which is fitted to the lower extremity of body 61, and which is capable of being displaced in a limited way by rotation and translation in relation to said body. As before, plate 73 includes a drillhole 76 which permits the water mixed with the liquid soap to flow into chamber 77 situated below plate 73, and then through orifices 78 situted in the base of cap 75. Cap 75 consists of helicoidal slots 79 which fit in a peripheral strip 80, which is situated such that a limited rotation (for example $\frac{1}{4}$ turn) of cap 75 moves it from its high position (represented in the figure) to its lowest position (not shown).

As was the case with the device in FIGS. 3A and 3B, the body 61 consists of water supply orifice 81 which is in contact with a passage 82 which permits connection of orifice 81 with either chamber 77 or chamber 83 situated between plate 73 and membrane 68. In this form, passage 82 consists of a ring-shaped cut-away located in body 31.

As with the device shown in FIGS. 3A and 3B, the present design form is distinguished by the absence of the ball valve, which is only used when the body of the shower head consists of a tank, so as to prevent this tank from being under pressure during the functioning of the device.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed:

1. A mixing device for mixing a first fluid with a second fluid, said second fluid being contained in a pressurized stream, said mixing device comprising a housing including second fluid inlet means, second fluid outlet means, second fluid conduit means for directing said second fluid stream from said second fluid inlet means to said second fluid outlet means, and a first fluid chamber within said housing for holding a predetermined quantity of said first fluid, said first fluid chamber including a closure surface, an inlet, and an outlet, and said mixing device further comprising membrane means slidably contained within said first fluid chamber, said membrane means including a first surface in contact with said first fluid within said first fluid chamber, a second surface facing said closure surface, and an orifice connecting said first and second surfaces so that said first fluid can flow out of said first fluid chamber through said orifice, bias means in contact with said first surface of said membrane means so as to normally urge said second surface of said membrane means against said closure surface so as to prevent the flow of said first fluid through said orifice, second fluid control means for selectively directing at least a portion of said second fluid stream through said inlet of said first fluid chamber against said second surface of said membrane means so as to urge said membrane means against said bias means to thereby separate said second surface of said membrane means from said closure surface and expose said orifice, thereby permitting any of said first fluid contained within said first fluid chamber to flow through said orifice so long as said second surface of said membrane means is separated from said closure surface and mix with said second fluid to create a fluid mixture, and fluid mixture conduit means for directing said fluid mixture from said outlet of said first fluid chamber to said second fluid outlet means.

2. The mixing device of claim 1 wherein said first fluid comprises a liquid cosmetic product and said second fluid stream comprises a pressurized stream of water.

3. The mixing device of claim 1 wherein said second surface of said membrane means includes a central raised portion normally in contact with said closure surface, and an annular surface surrounding said central raised portion, said annular surface normally separated from said closure surface, said orifice being associated with said central raised portion.

4. The mixing device of claim 3 wherein said central raised portion and said annular surface of said second surface of said membrane means are located in substantially parallel planes, and are connected by means of a slanted surface therebetween.

5. The mixing device of claim 1 wherein said bias means comprises a coil spring.

6. The mixing device of claim 1 wherein said second fluid control means comprises a dual position sluice gate.

7. The mixing device of claim 1 wherein said second fluid outlet means includes a first portion and a second portion, said first portion of said second fluid outlet means being in contact wih said second fluid conduit means for receiving said second fluid from said second fluid inlet means, and said second portion of said second fluid outlet means being in contact with said fluid mixture conduit means for receiving said fluid mixture from said first fluid chamber.

8. The mixing device of claim 7 wherein said first portion of said second fluid outlet means comprises a central portion, and said second portion of said second fluid outlet means comprises an annular portion surrounding said central portion.

9. The mixing device of claim 1 wherein said first fluid chamber is in fluid communication with a supplementary first fluid tank, and including valve means between said first fluid chamber and said supplementary first fluid tank to control the flow of fluid therebetween.

10. The mixing device of claim 9 wherein said valve means comprises a one-way valve thereby preventing the flow of said first fluid from said first fluid chamber back to said supplementary first fluid tank.

11. The mixing device of claim 1 wherein said first fluid chamber has a cylindrical shape, said closure surface comprising one end of said cylindrical shape, and wherein said membrane means is circular, having a diameter which approximates that of said first fluid chamber whereby said membrane means may be slidably moved within said first fluid chamber by the application of a pressure sufficient to overcome the small degree of friction between said membrane means and said first fluid chamber.

12. The mixing device of claim 1 wherein said closure surface is movable, and wherein second fluid control means comprises means for moving said closure surface in a direction away from said second surface of said membrane means.

13. The mixing device of claim 12 wherein said closure means is connected to said second fluid outlet means, and wherein said means for moving said closure surface includes means for moving said second fluid outlet means in a direction away from said second surface of said membrane means.

14. The mixing device of claim 1 wherein said housing comprises a shower head body.

15. The mixing device of claim 14 wherein said shower head body includes first and second shower head body members movable with respect to each other, said first shower head body member including said first fluid chamber and said second shower head body member including said second fluid outlet means.

16. The mixing device of claim 15 wherein said closure means is connected to said second shower head body member for movement therewith.

17. The mixing device of claim 16 wherein said first and second shower head body members are movable between two extreme positions with respect to each other, one in which all of said second fluid stream is directed through said second fluid conduit means and another in which all of said second fluid stream is directed through said first fluid chamber.

18. The mixing device of claim 17 wherein said first shower head body member includes a substantially cylindrical wall, and wherein said second shower head body member includes a substantially cylindrical wall, with said substantially cylindrical wall of said second shower head body member at least partially overlapping said substantially cylindrical wall of said first shower head body member.

19. The mixing device of claim 18 wherein said overlapping portions of said cylindrical walls of both said first and second shower head body members include thread means to provide for said relative movement therebetween.

20. The mixing device of claim 19 wherein said thread means comprise supplementary threads substantially separated from each other such that the rotation of said second shower head body member a portion of a turn in relation to said first shower head body member results in movement of said first and second shower head body members with respect to each other between said two extreme positions.

* * * * *